United States Patent [19]

Dyer

[11] Patent Number: 4,878,306

[45] Date of Patent: Nov. 7, 1989

[54] SHOTGUN CHOKE INSERTION AND REMOVAL TOOL

[76] Inventor: David P. Dyer, 1005 Arno Rd., Kansas City, Mo. 64113

[21] Appl. No.: 239,297

[22] Filed: Sep. 1, 1988

[51] Int. Cl.[4] ..... F41C 27/00

[52] U.S. Cl. ..... 42/90

[58] Field of Search ..... 42/79, 90

[56] References Cited

U.S. PATENT DOCUMENTS

| | | | |
|---|---|---|---|
| 764,243 | 7/1904 | Johnson | 42/90 |
| 4,386,477 | 6/1983 | Briley | 42/79 |
| 4,736,540 | 4/1988 | Holmes | 42/90 |

*Primary Examiner*—Charles T. Jordan

*Attorney, Agent, or Firm*—Hovey, Williams, Timmons & Collins

[57] ABSTRACT

A tool assembly is provided for facilitating insertion or removal of an end of barrel choke of an interchangeable choke shotgun. One component of the assembly consists of a tool adapted to be telescoped into a choke in driving engagement therewith. The other tool component is a cordless, reversible drive, portable power unit which may be releasably connected to the tool. The tool and thereby a choke in telescoped relationship thereto is driven in a direction by the power unit to rapidly insert the choke or effect removal thereof from the gun barrel. The assembly has particular utility in sporting clay competition where chokes must be changed at each of a multiplicity of target stations.

11 Claims, 1 Drawing Sheet

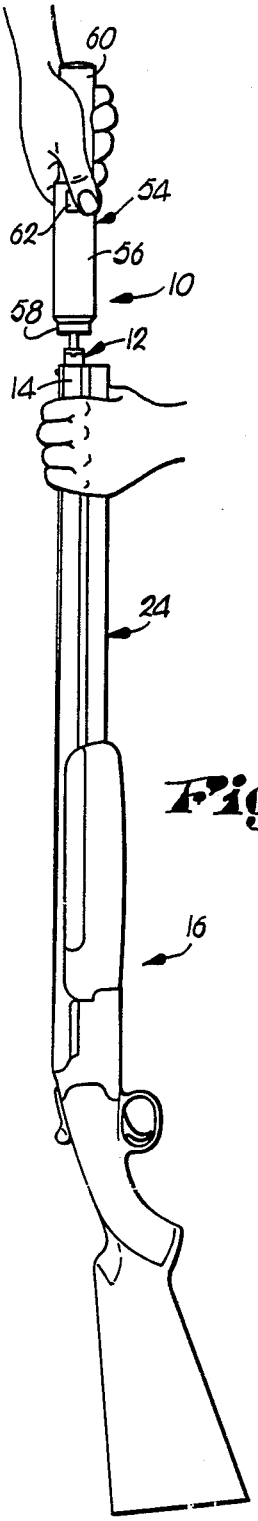
Fig.1.
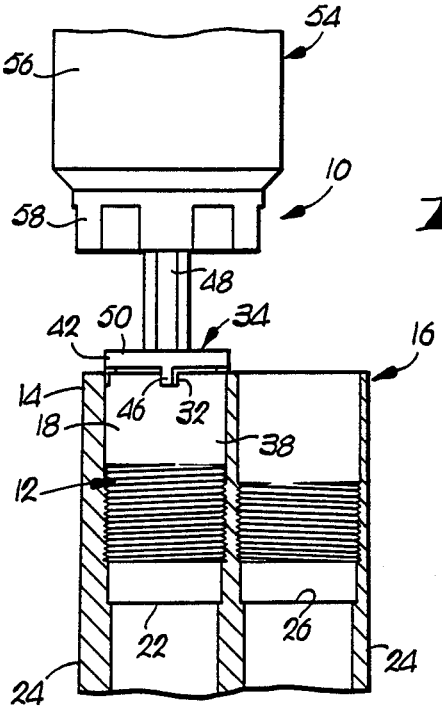
Fig.3.
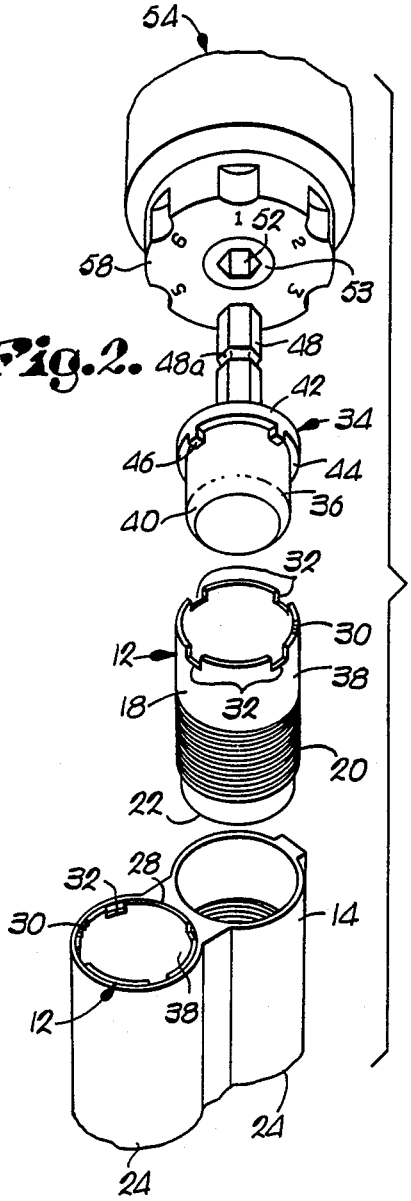
Fig.2.
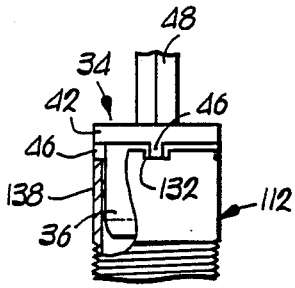
Fig.4.
Fig.5.
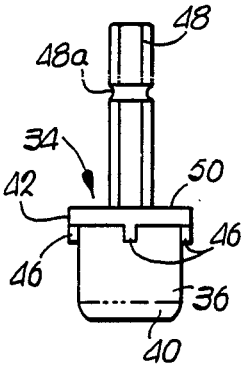
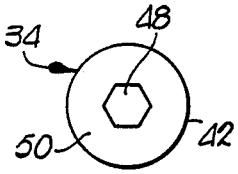
Fig.6.
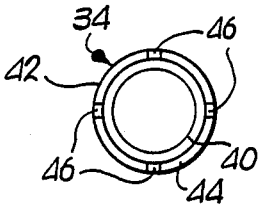
Fig.7.

SHOTGUN CHOKE INSERTION AND REMOVAL TOOL

BACKGROUND OF THE INVENTION

1. Field of the Invention

This invention relates to a power operated tool assembly for facilitating the insertion or removal of an end barrel choke of an interchangeable choke shotgun. In particular, the tool assembly allows a sportsman to quickly insert or remove a choke from the end of a shotgun barrel utilizing a cordless, portable, reversible drive power unit permitting the chokes to be easily changed in the field.

2. Description of the Prior Art

In order to increase the versatility of a shotgun, a number of suppliers have for many years manufactured models which permit any one of a number of interchangeable chokes to be removably screwed into the outer end of the gun barrel. In this manner, the expense of purchasing extra barrels or guns is avoided. A large variety of screw-in chokes are now available which control the discharge pattern of the shotgun pellets. The smallest diameter pattern is provided by what is known as an extra full choke. In ascending order of spread from the extra full choke are chokes such as full, improved modified, modified, improved cylinder, skeet 1, skeet 2 and cylinder.

Each of the interchangeable chokes comprises a cylinder having external threads which are adapted to be complementally threaded into an internally threaded section of the outer end of the shotgun barrel. Identifying serrations are formed in the normally outermost extremity of each choke so that a user can tell at a glance or even by feel which type of choke is at hand or already screwed into the gun barrel.

In recent years, particularly in the United States, participation in "sporting clays" has increased dramatically because of the different challenge that it offers to shooters. In this sport, the marksman moves from station to station where clay pigeons are released in different trajectories. For example, at a first station, one clay pigeon may be directed toward the shooter while another is projected away from him. At a second station, two clay pigeons may be released at the same time; at a third station the second clay may be delayed one-half second behind the first release. Another station may have what are known as report pairs, i.e. when the gun fires at the first clay, then the second clay is released. In criss-cross pairs, two clays are released simultaneously in a crossing pattern. Fast running ground animals are sometimes simulated by release of essentially horizontally projected clays close to the ground.

As can be appreciated from the foregoing, sporting clay competition involves target techniques which are substantially different from those required for conventional skeet shooting. Because of the different trajectories of targets in sporting clays, it is desirable that the marksman be able to select a particular choke for each station depending upon the direction of the clay released and its distance from the position where the marksman stands.

In view of the number of choke changes normally required when traversing a sporting clay's course involving a large number of different positions in clay trajectories, it is desirable that the shooter be able to change the chokes quickly and efficiently between stations. Although manually manipulable tools have been provided allowing the shooter to insert and remove a choke by turning the tool available for this purpose,the extremely fine threads which are conventionally employed with screw chokes makes insertion and removal of various chokes a time-consuming and onerous task.

SUMMARY OF THE INVENTION

A tool assembly is provided that allows a sportsman to quickly and easily insert or remove a choke from the end of an interchangeable choke shotgun barrel by employing a tool constructed to be complementally telescoped into one end of a cylindrical choke and provided with a projection thereon strategically located to be received within a notch therefor in the normally outermost end of the choke. An extension projecting from the tool is especially designed to be removably received within a cavity therefor in a cordless, portable power unit having a selector switch which controls operation of the power device to either rotate the tool and thereby the choke telescoped thereover in a direction to thread the choke down into the outermost end of the gun barrel, or to rapidly effect removal of such choke from the barrel.

The power driven tool is designed so that it will fit in any of the conventional chokes now supplied by a number of different gun manufacturers including Winchester, Browning, Ruger, Beretta and Remington. Chokes manufactured by all the suppliers have a plurality of notches in the normally outermost lip of each choke for receipt of a tool for rotating the respective choke. However, the effective width and depth of these notches varies from choke manufacturer to choke manufacturer. The tool of the present invention is designed such that it will accommodate all of the different sizes of choke notches and still effectively function to rotate the choke for insertion or removal thereof without damage to the choke lip.

BRIEF DESCRIPTION OF THE DRAWINGS

FIG. 1 is a perspective view of an interchangeable choke shotgun showing the way in which the tool assembly of the present invention may be used to quickly insert or remove a choke from the end of the gun barrel;

FIG. 2 is a fragmentary perspective exploded view of the outermost end of an over and under interchangeable choke shotgun, and choke which is shown removed from one barrel of the gun, a tool constructed to be telescopically received in the cylindrical choke, and a cordless, portable power unit for rotating the tool in either direction;

FIG. 3 is an enlarged fragmentary view similar to FIG. 2 but showing the components in operative interrelationship and with the over and under gun barrels being shown in cross-section;

FIG. 4 is a fragmentary side elevational view of a cylindrical choke different from the choke illustrated in FIGS. 2 and 3 but depicting the way in which the tool of the present invention is constructed such that it will operate effectively in connection with various types of chokes;

FIG. 5 is a side elevational view of a preferred embodiment of the tool of the present invention;

FIG. 6 is a top elevational view of such tool; and

FIG. 7 is a bottom elevational view of the tool shown in FIGS. 5 and 6.

DETAILED DESCRIPTION OF THE PREFERRED EMBODIMENT

As is most evident in FIG. 1, the tool assembly of this invention broadly designated by the numeral 10 is particularly useful for quickly and easily inserting or removing a cylindrical choke 12 normally mounted in the outermost end 14 of an interchangeable choke shotgun broadly designated 16. For illustrative purposes only, shotgun 16 is shown as being of the over and under type. However, it is to be understood that tool assembly 10 is equally useful for facilitating the insertion or removal of an end of barrel choke for single barrel, double barrel, and over and under barrel shotguns.

As best seen in FIGS. 2 and 3, a conventional screw choke 12 is a cylindrical, relatively thin walled metal member 18 having fine pitch external threads 20 adjacent to but somewhat spaced from the normally innermost circular end 22 of member 18. The outside diameter of the choke 12 is such that it telescopes within the outer end 14 of a respective gun barrel 24 in closely conforming, substantially complemental relationship. Each barrel 24 of an interchangeable choke shotgun 16 generally has an internal shoulder 26 which limits the extent of insertion of a choke 12 in a corresponding barrel.

As previously pointed out, the removable chokes 12 for an interchangeable choke shotgun have means in the outermost lip 28 remote from the end 22 serving as identifying indicia for the type of choke. Serrations 30 in lip 28 are generally provided for this purpose in that they allow both visual and tactile identification of the particular type of choke by the sportsman.

Chokes 12 conventionally provided for interchangeable choke shotguns also are normally provided with four notches 32 in the lip portion 28 thereof for engagement by an insertion and removal tool. As will be explained, the depth and effective width of notches 32 in the body 18 of the chokes made by different shotgun manufacturers varies from maker to maker.

The choke insertion and removal tool 34 forming a part of assembly 10 has a cylindrical body 36 of a diameter to be telescopically received within the outermost end 38 of the interchangeable choke 12. In the preferred embodiment of the invention, body 36 is a solid piece of stainless steel; however, the tool body could be a cylindrical component with or without an end wall across the portion of such body which telescopes to the greatest extent within the choke 12. In any event, in the instance of the preferred construction wherein the body 36 is of solid construction, the normally innermost end of such tool 34 is chamfered as at 40 to facilitate telescoping of the body 36 into choke 12 notwithstanding the close tolerance fit between the outer diamter of the body 36 and the inner diameter of choke 12.

A circular flange 42 is provided on tool body 36 at the normally outermost end of body 36 remote from chamfer 40 and of a larger diameter than the outside diameter of body 36. Flange 42 thereby presents a surface or shoulder 44 which overlies and engages the outer surface of lip 28 of choke 12 during telescopic insertion of body 36 into the end 38 of the choke 12. Flange 42 thereby serves to limit the degree of introduction of the tool body 36 into a respective choke 12.

The tool 34 is also provided with four projections 46 thereon which extend radially outwardly from the outer cylindrical surface of body 36 and are integral with the latter as well as the shoulder portion 44 of the flange 42. The four projections 46 are spaced 90° apart and located to be received within corresponding notches 32 in end 38 of the choke 12. As is illustrated in FIG. 3, each of the projections 46 is of a width such that it will be received in a notch 32 of the narrowest extent of the commercially available chokes now being supplied by the different shotgun manufacturers.

An elongated extension 48 is integral with and projects upwardly from the outermost face 50 of the flange 42 joined to tool body 36. Extension 48 is preferably hexagonal in transverse cross-section and is coaxial with cylindrical body 36.

Extension 48 of tool 34 is designed to be complementally received within a transversely hexagonal, elongated cavity 52 in the rotatable drive spindle 53 of a power unit broadly designated 54. A groove 48*a* in extension 48 is adapted to receive a spring biased ball detent within unit 54 to releasably retain the extension in cavity 52.

Although power unit 54 may take a number of different forms, in its preferred embodiment, unit 54 is made up of an elongated, generally cylindrical housing 56 provided with a rotatable torque control device 58 on one end thereof. Selective rotation of the component 58 thereby varies the torque applied by power unit 54 to tool 34 telescoped into the apertured spindle 53.

Although not illustrated in detail since the nature of such construction is conventional, it is to be understood that the power unit 54 embodies a small DC motor and associated gearing for driving the spindle 53 in response to energy generated by a rechargeable nicad battery housed within the end 60 of housing 56. A finger operated switch control 62 on housing 56 permits the user of tool assembly 10 to cause the spindle 53 to be rotated in either a clockwise or a counterclockwise direction as selected. The control switch 62 also functions to turn the power unit on or off.

As indicated, the power unit 54 has internal rechargeable nicad batteries and for this purpose, means (not illustrated) is provided for connecting the rechargeable batteries to a source of recharging current to maintain the charge on the batteries. It is, therefore, evident that power unit 54 may be described as a cordless, portable power unit permitting chokes 12 to be easily changed in the field.

OPERATION

In the use of tool assembly 10, and assuming that a choke 12 is to be inserted in the righthand barrel 24 of shotgun 16 as depicted in FIG. 2, tool 34 is connected to the portable driver unit 54 by inserting extension 48 into cavity 52. The particular choke 12 selected by the marksman to be inserted in the outermost end 14 of barrel 24 is telescoped over body 36 in a manner such that projections 46 are complementally received within respective notches 32. The choke 12 is then inserted in the outermost end of barrel 24 in a manner as shown in FIG. 1. While holding the shotgun barrel or barrels with one hand, the other hand of the sportsman is then used to grasp the power drive unit 54 and maintain the choke 12 as well as the tool 34 and drive unit 54 in coaxial relationship with the barrel. The switch control 62 is manipulated in a direction to cause the tool 34 and thereby choke 12 to be rotated in a direction to thread the choke into the outermost end of the barrel until such time as the end 22 of the choke 12 engages shoulder 26. It is to be appreciated in this respect that the choke 12 should be threaded into the gun barrel in a manner such that the choke firmly engages shoulder 26 so that there is no tendency for the choke to become dislodged from the gun barrel upon repeated firing of the weapon. The internal gearing conventionally provided in the power unit 54 is adequate to provide sufficient torque to firmly install choke 12 in the barrel 24 of the shotgun 16.

As previously indicated, the torque applied to tool 34 by power unit 54 may be adjusted as desired to assure requisite tightening of choke 12 in the barrel 24 without overtorqueing which would preclude subsequent removal of choke 12 using power unit 54 in the manner described. Noteworthy in this respect is the fact that the power unit 54 may comprise a cordless power screwdriver of the type which are widely marketed with nicad rechargeable batteries. These rechargeable screwdrivers are available with ¼ inch wide cavities; hence, the extension 48 of tool 34 should be similarly of the same size to be complementally received in the driver cavity.

By virtue of the controlled rotation of spindle 53 of power unit 54 at a relatively rapid rate, the choke 12 may be quickly and easily installed in the shotgun barrel. By the same token, a choke 12 may be removed from the end of the shotgun barrel 24 by simply reversing the procedure previously described. In this instance, after telescoping of the tool 34 into the choke 12 to be removed, the switch control 62 may simply be moved in a direction to cause the spindle 53 and thereby the tool 34 to be rotated in the opposite direction for unthreading of the choke at a rate commensurate with the speed at which the choke was installed.

In FIG. 4, the choke 112 differs from choke 12 in that the notches 132 in the normally outermost end 138 thereof are wider and not as deep as the notches 32 in choke 12. No damage is caused to the choke 112 during insertion or removal thereof, however, because the tool 34 simply turns until the projections 46 engage an upright surface defining a corresponding notch in the choke whereupon the latter is then rotated in a direction dependent upon the clockwise or counterclockwise rotation of the tool 34.

The releasable connectiin of the tool 34 to power unit 54 is also important in that tools of somewhat different configuration may be employed if desired for particular chokes yet only a single cordless power drive unit is needed for the various choke installation and removal tools.

I claim:

1. A tool assembly for facilitating the insertion or removal of an end of barrel choke of an interchangeable choke shotgun of the type wherein each choke has at least one tool engaging notch in its outer end and external threads that are adapted to be complementally threaded into internal threads therefor in the end of the gun barrel, said tool assembly comprising:

a tool body adapted to be telescoped into the normally outermost end of a selected choke to be inserted into the the gun barrel or removed therefrom and when so inserted into the choke having a first inner extremity and a second outward facing extremity, said body having a projection thereon located to be received within a tool engaging notch in the choke when the body is inserted into said selected choke, and an extension projecting from said second extremity of the tool body and secured to the latter so as to effect rotation thereof in either direction in response to turning of the extension; and an electrically actuated, reversible drive, portable power unit connected to the extension on said tool body for selectively rotating the body in one direction to rapidly thread a choke telescoped thereover into said outer end of the shotgun barrel upon a first command to the power unit or to rapidly remove a choke from the barrel in response to a second command to the power unit by effecting rotation of the tool body in the opposite direction thereof while telescoped into the choke.

2. A tool assembly for facilitating the insertion or removal of a shotgun barrel choke as set forth in claim 1, wherein the body is essentially a cylindrical element and means is provided on the body engageable with the selected choke for limiting the extent of telescoping of the body into the choke.

3. A tool assembly for facilitating the insertion or removal of a shotgun barrel choke as set forth in claim 1, wherein the power unit is releasably connected to the extension on the tool body.

4. A tool assembly for facilitating the insertion or removal of a shotgun barrel choke as set forth in claim 1, wherein said extension is polygonal in cross-section and the power unit has a cavity therein for temporarily and complementally receiving the extension.

5. A tool assembly for facilitating the insertion or removal of a shotgun barrel choke as set forth in claim 1, wherein the projection on the tool body is of dimensions such that it will be received in the smallest notch provided in a series of interchangeable screw thread chokes having insertion and removal notches therein of different sizes.

6. A tool assembly for facilitating the insertion or removal of a shotgun barrel choke as set forth in claim 1, wherein said power unit is of the rechargeable battery type which precludes the necessity of an electrical power cord being connected thereto during normal use.

7. A tool assembly for facilitating the insertion or removal of a shotgun barrel choke as set forth in claim 1, wherein the tool body is a cylindrical element of an external diameter only slightly less than the internal diameter of the selected choke for complemental receipt of the body in the choke, said projection on the body being disposed to extend laterally from the side wall of the element, and a flange on the body adjacent said outwardly facing extremity thereof for engaging the outer end of the choke for limiting the extent of telescoping of the element into the choke.

8. A tool assembly for facilitating the insertion or removal of a shotgun barrel choke as set forth in claim 7, wherein the flange is integral with the element and the projection is integral with the flange and said element.

9. A tool assembly for facilitating the insertion or removal of a shotgun barrel choke as set forth in claim 1, which is adapted to be used with a selected choke having at least a pair of insertion and removal notches in the normally outermost lip thereof and wherein the tool body is provided with projections thereon configured and arranged to be received within repective notches in the choke.

10. A tool assembly for facilitating the insertion or removal of a shotgun barrel choke as set forth in claim 1, wherein the power unit is an elongated generally cylindrical device having its longitudinal axis aligned with the axes of the extension and said body.

11. A tool for facilitating the insertion or removal of an end of barrel choke for an interchangeable choke shotgun of the type wherein each choke has as least one tool engaging notch in its outer end and external threads that are adapted to be complementally threaded into internal threads therefor at said end of the gun barrel, said tool comprising:

a tool body adapted to be telescoped into the normally outermost end of a selected choke to be inserted into the gun barrel or removed therefrom and when so inserted into the choke having a first inner extremity and a second outwardly facing extremity, said body having a projection thereon located to be received within a tool engaging notch in the choke when the body is inserted into said selected choke, and an extension projecting from said second extremity of the tool body and secured to the latter so as to effect rotation thereof in either direction in response to turning of the extension, said extension on the tool body being adapted to be releasably connected to an electrically actuated, reversible drive, portable power unit for effecting selective rotation of the extension and thereby the tool body so that the latter when telescoped into a choke may be rotated to insert the choke into the outer end of the gun barrel when one command is given to the power unit and to effect removal of a choke telescoped over a tool body when a second command is given to the power unit.

* * * * *